United States Patent [19]

Adams et al.

[11] Patent Number: 4,585,261

[45] Date of Patent: Apr. 29, 1986

[54] VEHICLE CLOSURE LATCH

[75] Inventors: Frederic R. Adams, Mt. Clemens; Stanley Kwasiborski, Jr., Hazel Park; Ronald P. Rimbey, Utica, all of Mich.

[73] Assignee: General Motors Corporation, Detroit, Mich.

[21] Appl. No.: 673,673

[22] Filed: Nov. 21, 1984

[51] Int. Cl.[4] ..... E05C 3/26

[52] U.S. Cl. ..... 292/216; 292/336.3

[58] Field of Search ..... 292/216, 280, DIG. 62, 292/DIG. 23, DIG. 24, DIG. 25, DIG. 26, 336.3, DIG. 27, DIG. 43

[56] References Cited

U.S. PATENT DOCUMENTS

| | | | |
|---|---|---|---|
| 2,692,157 | 10/1954 | Soderberg | 292/87 X |
| 3,113,447 | 12/1963 | Oishei | 292/DIG. 43 X |
| 3,791,686 | 2/1974 | Horozawa | 292/216 |
| 3,848,909 | 11/1974 | Foley | 292/216 |

FOREIGN PATENT DOCUMENTS

| | | |
|---|---|---|
| 2,624,730 | 12/1977 | Fed. Rep. of Germany. |
| 2,090,049 | 6/1982 | United Kingdom. |

OTHER PUBLICATIONS

Zebelman, et al., A Time-Zero Detector Utilizing Isochronous Transport of Secondary Electrons, Nuclear Instruments and Method, 141 (1977) 439–447.

*Primary Examiner*—Richard E. Moore

*Attorney, Agent, or Firm*—Herbert Furman

[57] ABSTRACT

A vehicle body door lock includes a pivoted operating lever connected to a pivoted transfer lever by a shiftable rod having a hooked end hooked through an opening in one end of the operating lever. The transfer lever rotates the operating lever against a spring bias. The position of the transfer lever relative to the frame is adjustably set by a bendable tab to eliminate lost motion between the hooked end of the rod and the operating lever and locate the levers and rod in rattle free relationship. The bight of the rod seats in an arcuate bearing area of the opening in the operating lever to reduce operating effort.

3 Claims, 9 Drawing Figures

VEHICLE CLOSURE LATCH

This invention relates generally to vehicle closure latches and more particularly to an operating lever arrangement for vehicle closure latches.

It is common in vehicle closure latches to provide an operating lever arrangement for connecting the inside and outside operators, such as handles or push buttons, to the detent mechanism for the bolt, either indirectly through an intermittent member or directly. Generally, such an arrangement includes an operating lever which is resiliently biased in one direction, and therefore must be located against the resilient bias. The arrangement also includes various shiftable members, such as rods or links, for connecting the operating lever to the inside and outside operators.

The arrangement of this invention includes a pivoted operating lever which is connected to the detent mechanism through a conventional intermittent member which is conventionally located in operating and non-operating position by a locking lever. The operating lever is resiliently biased in one direction relative to its pivot and is located against this bias by a shiftable transfer rod having one end hooked to one end of the operating lever and the other end secured to one leg of a bell crank transfer lever. The transfer lever is provided with a bendable tab which adjustably engages the frame of the closure latch to locate the transfer lever relative to the frame and thereby take up any lost motion between the transfer lever, transfer rod and operating lever by ensuring that the operating lever is under a resilient bias. The transfer lever is adjustably connected by a rod to the outside release handle. The other end of the operating lever is engageable by an inside release member which is connected by a rod to the inside operator.

In order to decrease operating effort, the one end of the operating lever may be provided with a pair of angularly related legs and a slot having an arcuate closed end in one of the legs. The transfer rod is of circular cross section. The bight of the hooked end of the transfer rod seats on the arcuate closed end of the slot and rotates relative to this end of the slot about an axis coaxial with the axis of generation thereof during shifting movement of the rod and rotation of the lever to decrease operating effort.

The primary feature of this invention is that it provides an improved vehicle closure latch wherein a pivoted operating lever, providing a connection between the inside and outside operators and the release mechanism for the latch bolt, is resiliently biased in a direction to take up lost motion between the operating lever, an adjustably located transfer lever, and a shiftable member connecting the transfer lever and the operating lever. Another feature is that the transfer lever is adjustably located relative to the frame of the closure latch to thereby ensure that the bias on the operating lever takes up the lost motion. A further feature is that the transfer member is a rod having a hooked end hooked through an opening in the operating lever. Yet another feature is that the opening in the operating lever has an arcuate end which is rotatably engaged by the bight of the hooked end of the transfer rod to provide a positive bearing area for the bight of the rod and thereby block shifting of such bight and rotation of the rod about its axis during rotation of the operating lever.

These and other features will be readily apparent from the following specification and drawings wherein.

Figure 1:
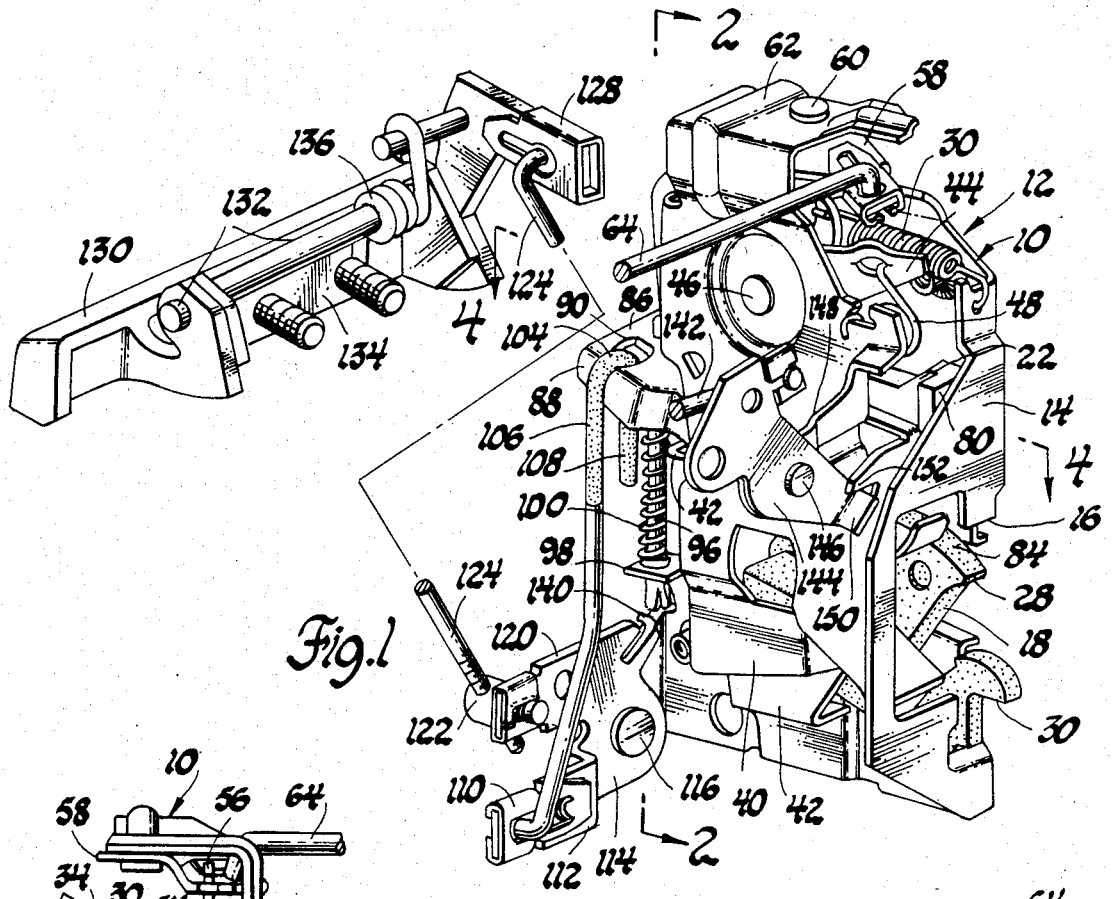
FIG. 1 is a perspective view of a vehicle closure latch according to this invention.

The vehicle closure latch 10 shown in FIGS. 1 through 4 of the drawings is substantially the same as a latch which has been widely used in present and previous production vehicles manufactured by the Assignee of this invention. In view of the widespread use of the latch, the details thereof are well known and therefore only a brief description of the operating components will be given.

The latch 10 includes a frame 12 having an integral side wall or flange 14, with the frame and side wall being apertured at 16 to provide for entrance and exit of a headed striker pin, not shown. The striker pin is mounted on the vehicle body lock pillar. A plastic coated fork type bolt 18 is pivoted at 20 to the frame 12. The bolt is shown in the released position. A detent 22 is pivoted at 24, FIG. 4, to the frame 12 and includes a foot or shoulder 26 which is engageable with either a shoulder 28 or a shoulder 30 of the bolt 18 to hold the bolt respectively in either intermediate latched or fully latched position. A tension spring 30 is hooked between a leg 34 of the bolt and the flange 14 of the frame to continually bias the detent 22 clockwise as viewed in FIGS. 2 and 3 towards engaged position with the bolt 18. The detent 22 is located against the bias of spring 32 by the engagement of a leg 36 thereof with a rubber bumper 38 secured to a lanced lateral tab of frame 12.

Figure 2:
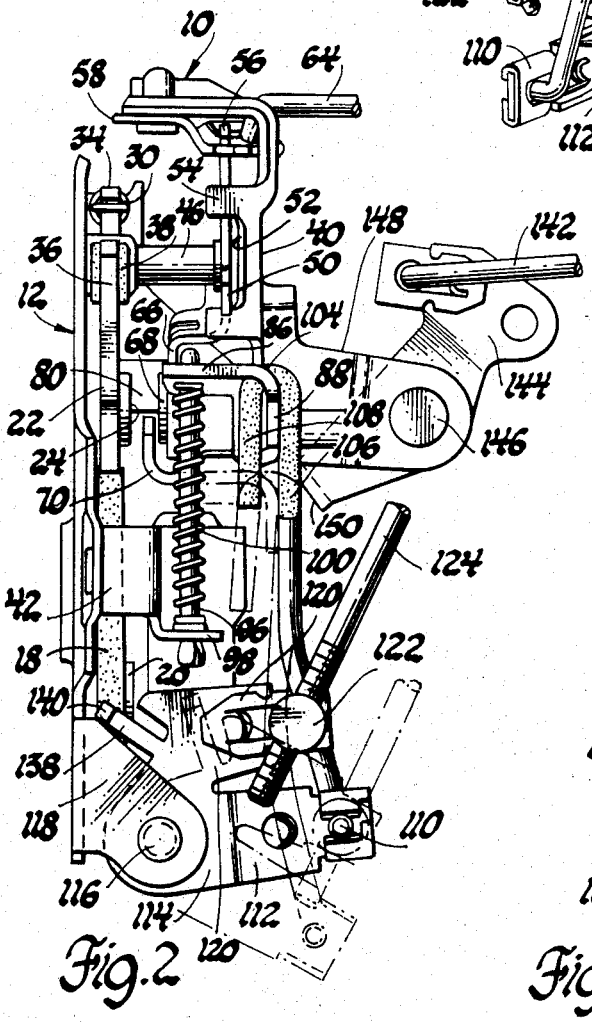
FIG. 2 is a view taken generally along the plane indicated by line 2—2 of FIG. 1.

A back plate 40 is spaced from the frame 12 and includes lateral tabs 42 which are staked to the frame 12 to secure the back plate thereto. A locking lever 44 is pivoted to a pin 46 extending between frame 12 and the back plate 40. An overcenter spring 48 is hooked between the locking lever 44 and the back plate 40 to selectively and alternately bias the locking lever to unlocked position, as shown, or to a locked position clockwise of this position. The locking lever 44 is alternately located in each position by respective engagement of a leg 50 thereof with the lower and upper edges of a U-shaped slot 52, FIG. 2, provided in a lateral tab 54 of the back plate 40. Another leg 56 of the locking lever extends upwardly and is trapped in a slot of an auxiliary lever 58 which is pivoted at 60 to a rib reinforced flange 62 of the back plate. The lever 58 is connected by a rod 64 to a conventional outside key cylinder to move the locking lever between locked and unlocked positions.

Figure 4:
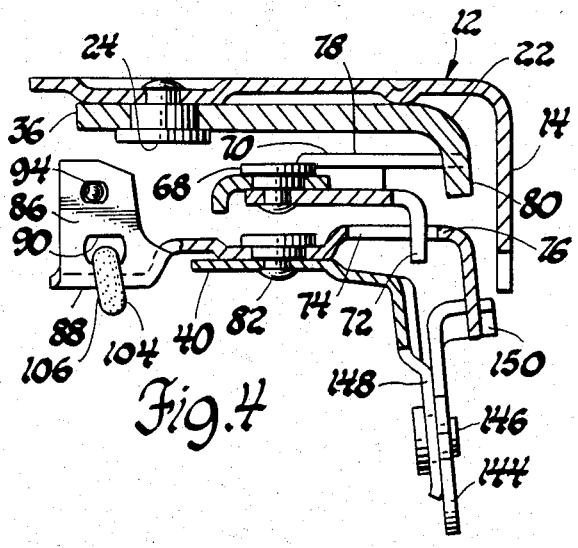
FIG. 4 is a sectional view taken along line 4—4 of FIG. 1.

An offset leg 66 of the locking lever 44 is pivoted at 68, FIGS. 2 and 4, to one leg of a U-shaped intermittent member 70. This leg includes a lateral tab 72 which extends through an arcuate slot 74 of an operating lever 76 for a purpose to be described. The other leg 78 of the intermittent member extends toward flange 14 and is movable into and out of abutting relationship to the lower edge of a lateral tab 80 of the detent 22. The operating lever 76 is pivoted at 82 to the back plate 40. The pivot 82 is coaxial with the pivot 68, FIG. 4.

When the locking lever is in its unlocked position, as shown, the leg 78 of the intermittent member 70 is in abutting relationship to the lower edge of the tab 80 of the detent 22. The intermittent member rotates the detent counterclockwise about its pivot 24 when the intermittent member is rotated counterclockwise about its pivot 68 by the operating lever 76. Should the bolt 18 be in either latched position with the foot 26 of the detent in engagement with either shoulder 28 or 30 of the bolt, counterclockwise rotation of the detent will release the detent foot from the engaged bolt shoulder to permit the door to be opened as the striker pin rotates the bolt to its unlatched position, as shown. The foot 26 of the detent 22 rests on the edge 84 of the leading leg of bolt 18. When the door is closed, the engagement of the striker pin with this leading leg rotates the bolt to latched position wherein the striker pin is trapped in the bolt throat and the detent foot 26 engages either shoulder 28 or shoulder 30.

Figure 3:
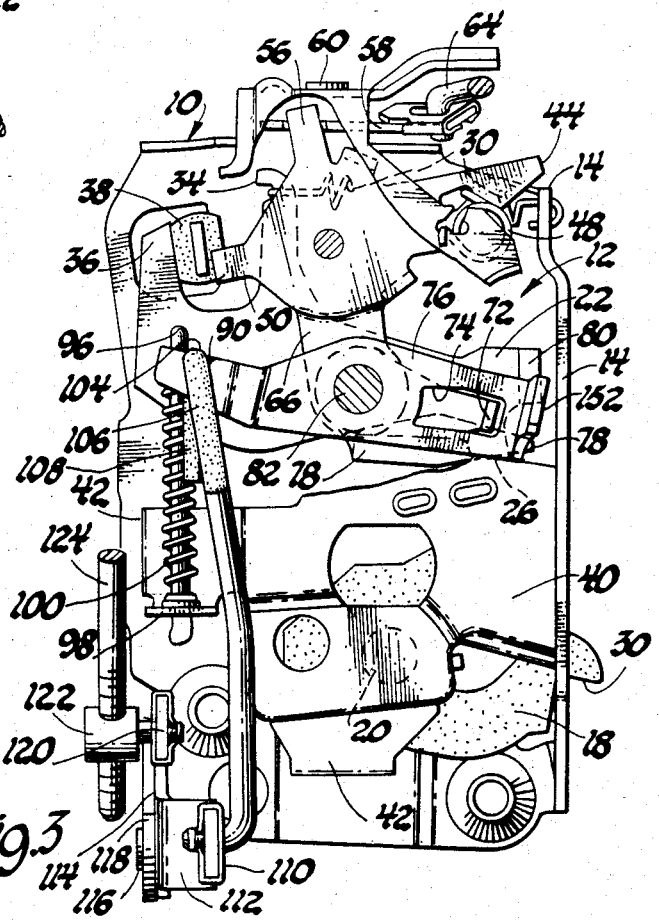
FIG. 3 is a partially broken away elevational view of the closure latch.

Should the locking lever be in its locked position, clockwise of its position shown, the leg 78 of the intermittent member will move to the left, FIGS. 3 and 4, and out of abutting relationship to the lower edge of the tab 80 so that rotation of the operating lever 76 will not have any effect on the detent 22.

The foregoing is a brief description of the manner in which the basic structure of the lock operates.

The operating lever 76 is included in the operating lever arrangement of this invention which will now be described.

As shown in FIGS. 1, 4 and 6 through 8, the lefthand end of the operating lever 76 includes a pair of legs 86 and 88 which are angularly related to each other, preferably normal to each other. A closed end slot 90 traverses both legs and the juncture therebetween, with the closed end of the slot in the leg 88 being arcuate to provide a bearing surface or area 92. The leg 86 includes an opening 94 which slidably receives the upper end of a pin 96, the lower shouldered end of which is staked to a tab 98 of back plate 40. A coil spring 100 surrounds the pin 96 and seats between the shouldered end of the pin and the lower surface of leg 86 to continually bias the lever 76 clockwise about its pivot 82.

Figure 7:
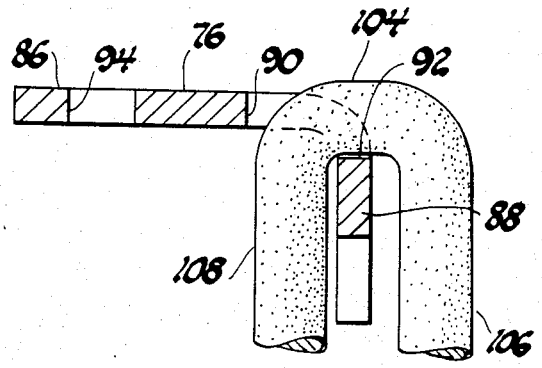
FIG. 7 is a sectional view taken along line 7—7 of FIG. 5.
Figure 8:
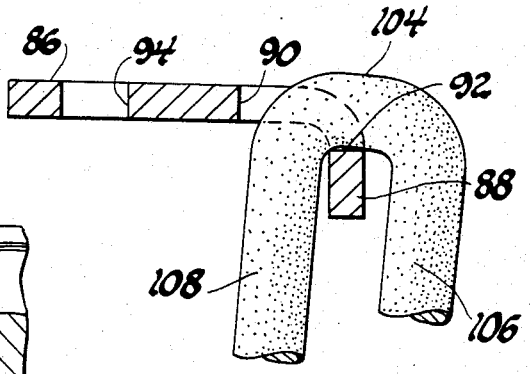
FIG. 8 is a sectional view taken along line 8—8 of FIG. 6.

The U-shape or hooked upper end 104 of a transfer rod 106 has the bight thereof rotatably seating on the bearing area 92 of slot 90 as shown in FIGS. 7 and 8. The rod 106 can be assembled to the lever by inserting the shorter leg 108 of the rod through the slot 90. The lower end of the rod 106 is bent laterally and secured by a conventional spring clip 110 to one offset leg 112 of a bell crank transfer lever 114. The lever 114 is pivoted at 116 to an integral lateral ear or arm 118 of the frame 12. The other leg 120 of the transfer lever 114 rotatably mounts a stud 122 which threadedly receives the lower threaded end of a rod 124. The rod 124, as shown in FIG. 1, extends upwardly and is secured by a conventional clip 128 to a conventional outside door handle 130 which is pivoted at 132 to a support 134 which is mounted on the outer panel of the vehicle body door. A spring 136 is secured between the handle 130 and the support 134 to continually bias cooperating stops on the handle and support into engagement, not shown.

As best shown in FIG. 2, the lever 114 includes an integral narrow bendable tab 138 having a terminal lateral flange 140 which is engageable with an edge of the ear 118 to locate the lever 114 in a counterclockwise direction relative to the ear.

After the transfer rod 106 is assembled between the operating lever 76 and the transfer lever 114, the tab 138 is bent relative to the lever 114 to locate the lever 114 about pivot 116 such that the resilient bias of spring 100 on operating lever 76 takes up any lost motion between the lever 76, rod 104 and transfer lever 114. This ensures that the lever 114 can be located relative to lever 76 by rod 106 in a rattle free position when the latch is assembled and that this position will remain throughout the life of the latch, unless positively changed by bending tab 138. The end portion 104 of the rod 106 can be coated with plastic to reduce the noise level.

Figure 5:
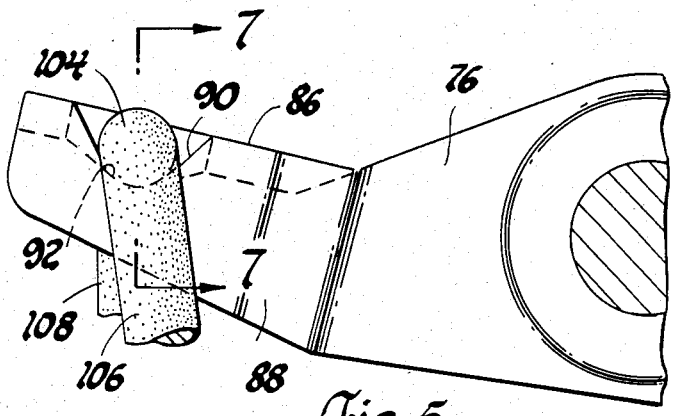
FIG. 5 is an enlarged view of a portion of FIG. 3 showing the hooked end of the transfer rod and one end portion of the operating lever in non-operating position.
Figure 6:
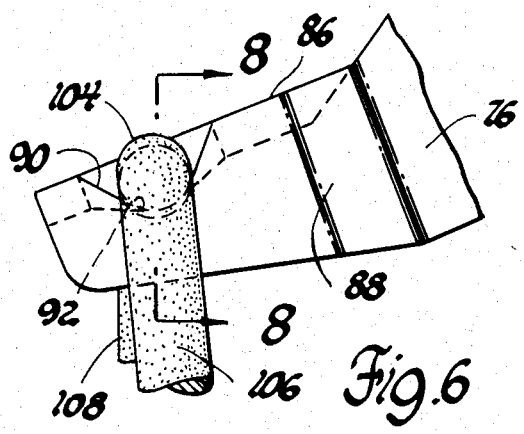
FIG. 6 is a view similar to FIG. 5 showing the operating lever and transfer rod in operating position.

When the lever 114 is rotated clockwise, FIGS. 1 and 2, by the outside handle 130 through downward shifting of the rod 124, the bight of end portion 104 of rod 106 rotates within the bearing area 92 as rod 106 shifts vertically, see FIGS. 5 and 6, rather than shift relative to lever 76 and rotate about its own axis. The rotation of bight 124 within bearing area 92 lessens or reduces the operating effort which must be applied to the handle 130 to rotate the lever 76. A plastic coating on end portion 104 reduces friction.

An inside release member, such as a handle, is connected by a rod 142, FIGS. 1 and 2, with an inside release lever 144 which is pivoted at 146 to an offset lateral flange or ear 148 of back plate 40. The lever 144 includes a lateral tab 150 which underlies a lateral tab 152 of the operating lever 76 so that rotation of the lever 144 in a counterclockwise direction as viewed in FIG. 1 or clockwise as viewed in FIG. 2 operates to rotate the lever 76 counterclockwise about its pivot 82.

It will be noted that rotation of the lever 76 by the rod 106 occurs without rotation of the lever 144 and likewise rotation of the lever 76 by the lever 144 occurs without any movement of the rod 106.

Figure 9:
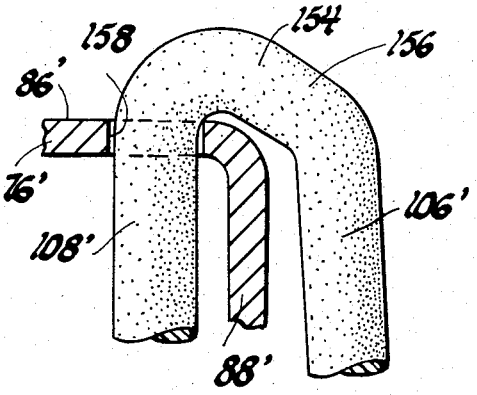
FIG. 9 is a view similar to FIG. 7 showing another embodiment.

FIG. 9 shows an alternate embodiment wherein the rod 106′ is provided with a flattened U-shaped portion 154 having the connecting portion 156 between the rod 106′ and the leg 108′ at an angle of approximately 120° to the former and 60° to the latter. Additionally, the slot 90 is dispensed with and only an opening 158 is provided in leg 86′ of lever 76′.

Thus this invention provides an operating lever arrangement for vehicle closure latches.

The embodiments of the invention in which an exclusive property or privilege is claimed are defined as follows:

1. A vehicle body door lock, comprising, in combination, a support, a first lever pivoted intermediate the ends thereof to the support, a second lever mounted on the support and operatively connected with one end of the first lever to rotate the first lever in one direction relative to the support, resilient means rotatably biasing the first lever in the other direction relative to the support, a third lever pivoted to the support, an elongated shiftable member having one end portion thereof pivoted to the third lever and having the other end portion thereof slidably received through an opening in the other end of the first lever and provided with an abutment means engageable with the first lever under the bias of the resilient means, and cooperating adjustable means in the third and on the support controlling the rotatable position of the third lever relative to the support to take up lost motion between the abutment means of the shiftable member and the first lever, rotation of the third lever shifting the shiftable member and rotating the first lever in the one direction against the bias of the resilient means, rotation of the first lever in the one direction by the second lever occurring independently of movement of the shiftable member as the other end of the first lever slides relative to the other end portion of the shiftable member and away from the abutment means.

2. A vehicle body door lock, comprising, in combination, a support, a first lever pivoted intermediate the ends thereof to the support, a second lever mounted on the support and rotatably engageable with one end of the first lever to rotate the first lever in one direction relative to the support, resilient means rotatably biasing the first lever in the other direction relative to the support, a third lever pivoted to the support, an elongated member having one end portion thereof pivoted to the third lever and the other end portion thereof provided with a hook formation including a pair of legs joined by a bight, one leg being slidably received through an opening in the other end of the first lever and the bight being engageable with an edge portion of the opening in the first layer under the bias of the resilient means, and cooperating adjustable means on the third lever and on the support controlling the rotatable position of the third lever relative to the support to take up lost motion between the abutment rotation of the third lever shifting the elongated member and rotating the first lever in the one direction against the bias of the resilient means, rotation of the first lever in the one direction by the second lever occurring independently of movement of the elongated member as the other end of the first lever slides relative to the one leg of the elongated member.

3. A vehicle body door lock, comprising, in combination, a support, a first lever pivoted intermediate the ends thereof to the support, one end of the first lever including a pair of angularly related portions joined by a juncture rib and an elongated opening extending between the portions across the rib and having a bearing area in one portion, resilient means rotatably biasing the first lever in one direction relative to the support, a second lever pivoted to the support, an operating rod having one end thereof pivoted to the second lever and the other end thereof provided with a hook formation including a pair of legs joined by a bight, one leg slidably extending through the opening in the other portion of the one end of the first lever and the bight engaging the bearing area in the one portion of the one end of the first lever, rotation of the second lever rotating the first lever in the one direction against the bias of the resilient means as the bight of the rod rotates in the bearing area, and cooperating means on the second lever and the support controlling the rotative position of the first lever against the bias of the resilient means.

* * * * *

UNITED STATES PATENT AND TRADEMARK OFFICE

CERTIFICATE OF CORRECTION

PATENT NO. : 4,585,261

DATED : April 29, 1986

INVENTOR(S) : Frederic R. Adams et al

It is certified that error appears in the above-identified patent and that said Letters Patent is hereby corrected as shown below:

Title Page, under "References Cited" delete the following:

FOREIGN PATENT DOCUMENTS

| | | |
|---|---|---|
| 2,624,730 | 12/1977 | Fed. Rep. of Germany. |
| 2,090 049 | 6/1982 | United Kingdom. |

OTHER PUBLICATIONS

Zebelman, et al., A Time-Zero Detector Utilizing Isochronous Transport of Secondary Electrons, Nuclear Instruments and Method, 141 (1977) 439-447.

Column 4, Claim 1, line 67 (Application Line 15) delete "in" and insert -- on -- and after "third" insert -- lever -- .

Signed and Sealed this

*Twelfth* Day of *August 1986*

[SEAL]

*Attest:*

*Attesting Officer*

DONALD J. QUIGG

*Commissioner of Patents and Trademarks*